US008730286B2

(12) United States Patent
Koroishi et al.

(10) Patent No.: US 8,730,286 B2
(45) Date of Patent: May 20, 2014

(54) THERMAL HEAD MANUFACTURING METHOD, THERMAL HEAD, AND PRINTER

(71) Applicant: Seiko Instruments Inc., Chiba (JP)

(72) Inventors: Keitaro Koroishi, Chiba (JP); Norimitsu Sanbongi, Chiba (JP); Toshimitsu Morooka, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 13/919,196

(22) Filed: Jun. 17, 2013

(65) Prior Publication Data

US 2013/0335499 A1 Dec. 19, 2013

(30) Foreign Application Priority Data

Jun. 19, 2012 (JP) ..... 2012-137797

(51) Int. Cl.
*B41J 2/335* (2006.01)

(52) U.S. Cl.
USPC ..... 347/200

(58) Field of Classification Search
USPC ..... 347/171, 200, 204, 205, 206, 209; 29/610.1, 611; 216/27
See application file for complete search history.

(56) References Cited

U.S. PATENT DOCUMENTS 8,253,765 B2 * 8/2012 Shoji et al. ..... 347/200
8,339,431 B2 * 12/2012 Sanbongi et al. ..... 347/200
8,477,166 B2 * 7/2013 Morooka et al. ..... 347/200

FOREIGN PATENT DOCUMENTS

JP 07-137318 A 5/1995
JP 2007-083532 A 4/2007

* cited by examiner

*Primary Examiner* — Kristal Feggins
(74) *Attorney, Agent, or Firm* — Brinks Gilson & Lione

(57) ABSTRACT

A method of manufacturing a thermal head, including: forming a concave being, which is open on one surface of a support-substrate made of an alumina material; forming an intermediate-layer made of a glass paste by printing the glass paste made of a first-glass-material on the one surface of the support-substrate and baking the glass paste; bonding an upper-substrate to the one surface of the support-substrate by arranging the upper-substrate on the intermediate-layer formed on the one surface of the support-substrate in a laminated state and heating the upper-substrate at a temperature of an annealing point thereof or higher and a softening point thereof or lower, the upper-substrate being made of a second-glass-material having a softening point lower than a softening point of the first-glass-material; and forming a heat generating resistor on a surface of the upper-substrate bonded to the support-substrate at a position opposed to the concave portion.

12 Claims, 6 Drawing Sheets

THERMAL HEAD MANUFACTURING METHOD, THERMAL HEAD, AND PRINTER

RELATED APPLICATIONS

This application claims priority under 35 U.S.C. §119 to Japanese Patent Application No. 2012-137797 filed on Jun. 19, 2012, the entire content of which is hereby incorporated by reference.

BACKGROUND OF THE INVENTION

1. Field of the Invention

The present invention relates to a thermal head manufacturing method, a thermal head manufactured by the method, and a printer equipped with the thermal head.

2. Description of the Related Art

As a thermal head to be used in a thermal printer, there is conventionally known a thermal head having a cavity portion which is formed in a region opposed to a heat generating resistor of a substrate and which functions as a heat-insulating layer having a low thermal conductivity. Due to this configuration, this conventional thermal head is designed to reduce an amount of heat to be transferred from the heat generating resistor to the substrate side, thereby improving heat generation efficiency and reducing power consumption.

In one example of this type of conventional thermal head, a groove or a through hole is formed in an electrically insulating substrate made of alumina, or the like. In this conventional thermal head, a low softening point material covers the groove or the through hole, a high softening point material covers the low softening point material, and baking is performed. In this way, the high softening point material becomes a glaze layer, and a cavity portion is formed between the substrate and the glaze layer by softening the low softening point material and causing the low softening point material to move into the groove or the through hole of the substrate.

In another conventional thermal head, a concave portion is formed in one of a substrate and a heat storage layer bonded thereto, and the concave portion is closed by the substrate and the heat storage layer so as to form a cavity portion therebetween. Alternatively, an adhesive layer to which the substrate and the heat storage layer are bonded is used, and there is provided a region in which the adhesive layer is not formed between the substrate and the heat storage layer so that the region serves as a cavity portion.

However, the above-mentioned conventional thermal heads have various problems. Specifically, in the former thermal head, the high softening point material is made of a glass paste having a softening point of 860° C., and hence, when baking is performed at 1,000 to 1,200° C., the high softening point material needs to be prevented from moving into the groove or the through hole together with the low softening point material, and a high heat-resistant film of SiNx, Sic, and the like is required to be provided as a partition on the low softening point material. Therefore, a sputtering step is necessary between paste printing of the low softening point material and paste printing of the high softening point material, and there is a problem of increased manufacturing cost and increased manufacturing time. Further, in order to prevent the groove or the through hole of the substrate from being filled when the low softening point material is printed, it is required to precisely control the temperature of the paste, the solvent concentration, the usage time, and the like so as to always maintain the viscosity of the glass paste to be constant. Therefore, even in this regard, there is a problem of increased manufacturing cost.

In the latter thermal head, when alumina for the substrate and glass for the heat storage layer are bonded to each other, the adhesive layer is necessary because the heat storage layer cannot be directly bonded to the substrate while maintaining the shape thereof. However, there is a problem in that a polymeric material becomes soft or deteriorated because of the heat generated in printing, the bonding force between the substrate and the heat storage layer is reduced at a high thermal expansion coefficient, and reliability is reduced. In the case where the substrate and the heat storage layer are bonded to each other using a glass paste for the adhesive layer, when the bonding temperature is set to be higher than a softening point of the glass paste, there is a problem in that the adhesive layer is liquefied to lose the shape thereof, and hence the cavity portion having a desired shape is not formed, and the expected thermal efficiency is not obtained. On the other hand, when the bonding temperature is set to be lower than the softening point of the glass paste, there is a problem in that a part where binder has evaporated becomes a cavity, glass particles are bonded to each other only in a point contact state, that is, a spongy state is produced, and the adhesive layer is crushed because of the pressurizing force of the platen roller. In the case where the glass paste is used to form the cavity portion, the shape other than the cavity portion needs to be subjected to printing and control. Therefore, in consideration of flowage of the paste and the like, the viscosity of the glass paste needs to be controlled precisely so as to be always constant, and there is a problem of increased manufacturing cost. Further, in the case where the glass is used for the substrate, heat is stored in the glass substrate, and tailing occurs when printing is performed continuously. Therefore, there is a problem in that the print quality is degraded and the printing speed is not fast.

SUMMARY OF THE INVENTION

Therefore, in this technical field, there are desired a method of easily and accurately manufacturing a thermal head which improves the print quality and increases the printing speed, the thermal head manufactured in this manufacturing method, and a printer including the thermal head.

According to one exemplary embodiment of the present invention, there is provided a method of manufacturing a thermal head, including: a support substrate processing step of forming one of a concave portion (or a through hole), which is open on one surface of a support substrate made of an alumina material; an intermediate layer forming step of forming an intermediate layer made of a glass paste by printing the glass paste made of a first glass material on the one surface of the support substrate and baking the glass paste; a bonding step of bonding an upper substrate to the one surface of the support substrate by arranging the upper substrate on the intermediate layer formed on the one surface of the support substrate in a laminated state and heating the upper substrate at a temperature of an annealing point thereof or higher and a softening point thereof or lower, the upper substrate being made of a second glass material having a softening point lower than a softening point of the first glass material; and a resistor forming step of forming a heat generating resistor on a surface of the upper substrate bonded to the support substrate at a position opposed to the concave portion (or the through hole) and the concave portion.

According to one exemplary embodiment of the present invention, the intermediate layer forming step includes printing the glass paste on the one surface of the support substrate and baking the glass paste so as to cover the one surface of the support substrate by the intermediate layer made of the glass paste and to cause the glass paste to flow into the one of the through hole and the concave portion, to thereby expose an opening thereof. Then, in the bonding step, the upper substrate is arranged on the one surface of the support substrate through the intermediation of the intermediate layer in a laminated state, and is bonded to the support substrate, and hence the upper substrate closes the exposed opening of the through hole or the concave portion. As a result, there is formed a laminated substrate having a cavity portion between the support substrate and the upper substrate.

The cavity portion functions as a hollow heat-insulating layer which blocks heat to be transferred from the upper substrate side to the support substrate side. In the resistor forming step, the heat generating resistor is formed on the surface of the upper substrate in such a manner that the heat generating resistor becomes opposed to the through hole or the concave portion of the support substrate. Therefore, there is manufactured the thermal head, in which the cavity portion may suppress dissipation of heat generated in the heat generating resistor to the support substrate side through the upper substrate and, in which an amount of available heat may be increased.

In this case, the through hole or the concave portion is formed in the support substrate in advance in the support substrate processing step, and therefore, even if the glass paste flows into the through hole or the concave portion in the intermediate layer forming step, the cavity portion having a desired shape is secured. Therefore, there is no need to form a high heat-resistant film as a partition or to precisely control the viscosity of the glass paste, and cost and manufacturing time are reduced.

Prior to the bonding step, the glass paste is baked to form the intermediate layer in the intermediate layer forming step. Therefore, even if the upper substrate is heated at a temperature of a softening point thereof or lower in the bonding step, a cavity due to binder removal is not generated in the intermediate layer, and the intermediate layer is maintained in the same state as that of glass. As a result, the strength of the intermediate layer is prevented from being reduced.

The upper substrate is heated at a temperature of an annealing point thereof or higher and a softening point thereof so as to be bonded to the support substrate, and therefore deformation of the upper substrate is prevented. Further, the first glass material for the intermediate layer has a softening point higher than that of the second glass material for the upper substrate, and hence the cavity portion having a desired shape is formed without losing the shape of the intermediate layer in the bonding step.

Further, when printing is performed continuously, excess heat generated in the heat generating resistor transfers from the upper substrate to the alumina substrate through the intermediate layer, and therefore high print quality with less tailing is obtained, and the printing speed is increased.

As a result, the thermal head which may improve the print quality and increase the printing speed is manufactured easily and at low cost.

In the case where, as the first glass material for the glass paste and the second glass material for the upper substrate, there are used materials having thermal expansion coefficients almost the same as that of the support substrate made of an alumina material, deformation due to heat generated in printing is not caused, and the bonding force is not reduced. Therefore, the highly-reliable thermal head is obtained.

In the one exemplary embodiment of the present invention, the method of manufacturing a thermal head may further include a thinning step of thinning the upper substrate bonded to the intermediate layer in the bonding step.

In this way, in the bonding step, instead of bonding an upper substrate too thin to be easily handled to the support substrate, an upper substrate thick enough to be easily handled is bonded to the support substrate. Therefore, the upper substrate is handled easily and safely.

According to one exemplary embodiment of the present invention, there is provided a thermal head manufactured by any one of the above-mentioned methods of manufacturing a thermal head.

According to one exemplary embodiment of the present invention, there is provided a printer, including the above-mentioned thermal head.

As described above, according to the one exemplary embodiment of the present invention, the thermal head which may improve the print quality and increase the printing speed is manufactured easily and accurately.

DETAILED DESCRIPTION OF THE PREFERRED EMBODIMENTS

A method of manufacturing a thermal head, a thermal head, and a printer according to an embodiment of the present invention are hereinafter described with reference to the attached drawings.

Figure 1:
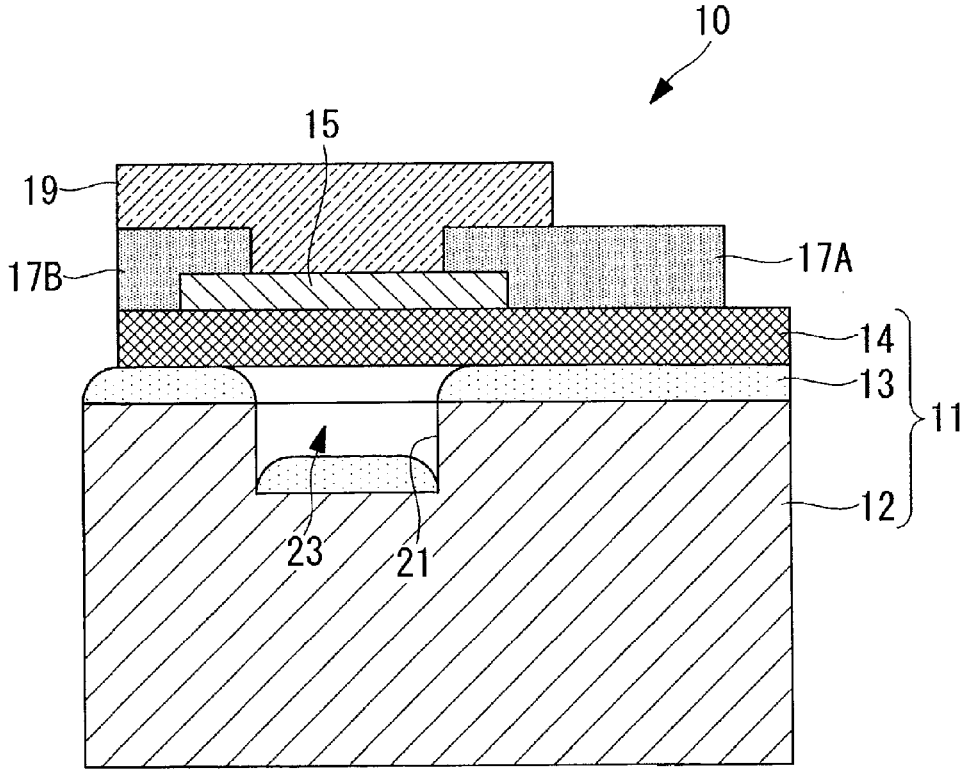
FIG. 1 is a vertical sectional view of a thermal head taken along a thickness direction, which is manufactured by a manufacturing method according to an embodiment of the present invention.

In the method of manufacturing a thermal head according to the embodiment of the present invention, for example, as illustrated in FIG. 1, a thermal head 10 to be used in a thermal printer (printer) (not shown) is manufactured. In the embodiment of the present invention, description is given of a method of manufacturing the plurality of thermal heads 10 by using a large support substrate 12 and a large upper substrate 14.

Figure 2:
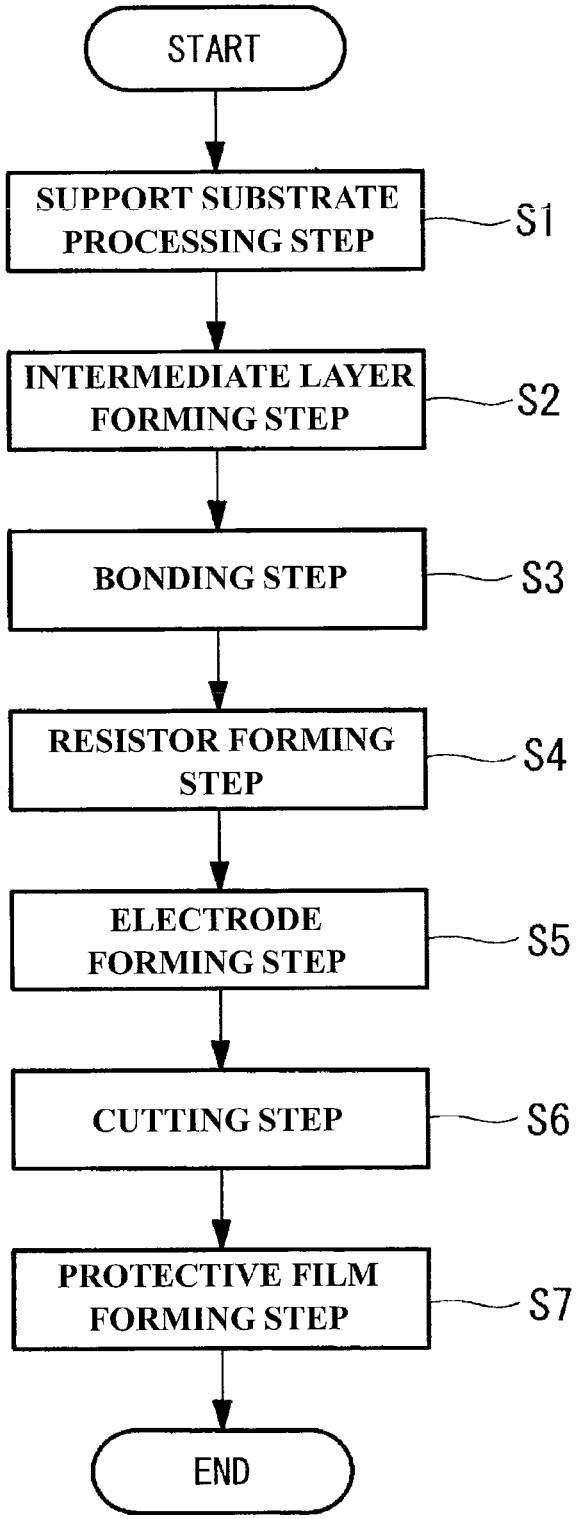
FIG. 2 is a flowchart illustrating the method of manufacturing a thermal head according to the embodiment of the present invention.

As illustrated in a flowchart of FIG. 2, the manufacturing method of the present invention includes a support substrate processing step S1 of forming a concave portion 21 which is open on one surface of the support substrate 12 made of an alumina material, an intermediate layer forming step S2 of forming an intermediate layer 13 by printing a glass paste 13*a* on the one surface of the support substrate 12 having the concave portion 21 formed therein, a bonding step S3 of bonding the upper substrate 14 made of glass to the one surface of the support substrate 12 through the intermediation of the intermediate layer 13, and a resistor forming step S4 of forming a plurality of heat generating resistors 15 at positions opposed to the concave portions 21 on a surface of the upper substrate 14 bonded to the support substrate 12.

The manufacturing method of the present invention further includes an electrode forming step S5 of forming electrode portions 17A and 17B connected to the heat generating resistor 15 on the surface of the upper substrate 14, a cutting step S6 of cutting the plurality of thermal heads 10 into the individual thermal heads 10, and a protective film forming step S7 of forming a protective film 19 on the upper substrate 14.

In the following, specific description is given of each step.

Figure 3A:
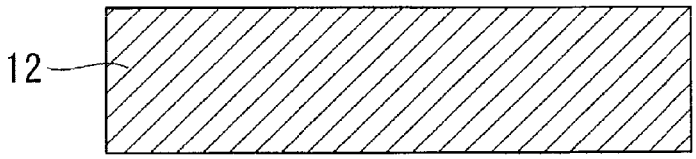
FIGS. 3A and 3B are vertical sectional views illustrating a support substrate processing step of the method of manufacturing a thermal head according to the embodiment of the present invention.

In the support substrate processing step S1, first, a green sheet is baked to form an alumina substrate (support substrate 12) having a rectangular parallelepiped shape as illustrated in FIG. 3A. Next, mechanical processing such as laser processing and drill processing is performed on the one surface of the formed support substrate 12 so as to form the concave portion 21 illustrated in FIG. 3B (Step S1).

Figure 3B:
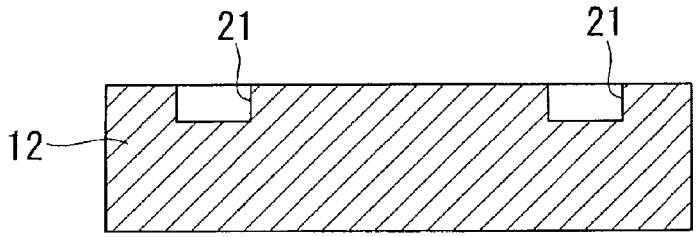

The concave portion 21 is formed to have a substantially rectangular shape extending along a longitudinal direction of the support substrate 12 (depth direction of the plane of FIG. 3B). For example, the concave portion 21 is desired to have a longitudinal dimension having such a size that all the heat generating resistors 15 to be formed in the resistor forming step S4 are opposed to the concave portion 21 in a plate thickness direction.

In this way, as compared to the case of separately forming a plurality of concave portions so as to be respectively opposed to the heat generating resistors 15, it is easier to perform processing, and higher efficiency is obtained.

It is preferred that the concave portion 21 have a width dimension (lateral direction of the plane of FIG. 3B) slightly larger than an effective heat generation width of the heat generating resistor 15, for example, a width dimension of about 200 μm. It is preferred that the concave portion 21 have a depth dimension (longitudinal direction of the plane of FIG. 3B) larger than a printing thickness of a glass paste to be printed on the support substrate 12 in the intermediate layer forming step S2, for example, a depth dimension of more than 50 μm in the case where the glass paste has a printing thickness of 50 μm.

Figure 3C:
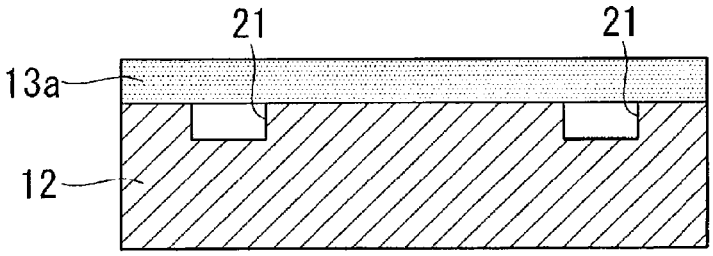
FIGS. 3C and 3D are vertical sectional views illustrating an intermediate layer forming step of the method of manufacturing a thermal head according to the embodiment of the present invention.
Figure 3D:
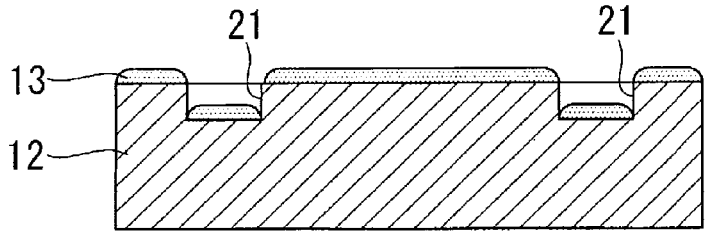

In the intermediate layer forming step S2, first, as illustrated in FIG. 3C, the glass paste 13*a* made of a first glass material is printed on the one surface of the support substrate 12 having the concave portion 21 formed therein. Next, as illustrated in FIG. 3D, the support substrate 12 having the glass paste 13*a* printed thereon is baked so as to form the intermediate layer 13 made of the glass paste 13*a* on the one surface of the support substrate 12 (Step S2).

As the first glass material, for example, a glass material having a softening point of 800° C. or higher is used. As a printing method, screen printing is used, for example. The printing thickness of the glass paste 13*a* may be, for example, exactly the same as that of the conventional thermal head, and the printing conditions may also be exactly the same as those of the conventional thermal head. Therefore, there is no need to set a new condition, and the glass paste 13*a* can be printed in the same mass production line as that of the conventional products. For example, the glass paste 13*a* is preferred to have a printing thickness of about 30 to 100 μm.

Further, the glass paste 13*a* may also be baked under the same condition as that of the conventional thermal head and in the same mass production line as that of the conventional products. For example, the support substrate 12 having the glass paste 13*a* printed thereon is left at 100 to 200° C. for approximately 30 minutes in order to evaporate the solvent and water in the glass paste 13*a*, and then, the support substrate 12 is baked at 1,000 to 1,300° C. for approximately 30 minutes to 1 hour.

When baked, the glass paste 13*a* printed over the concave portion 21 of the support substrate 12 melts and flows into the concave portion 21. The thickness of the glass paste 13*a* accumulated in the concave portion 21 is substantially the same as that of the intermediate layer 13 formed on the one surface of the support substrate 12, and hence the depth dimension and the shape of the concave portion 21 remain substantially the same even after formation of the intermediate layer 13.

The glass (intermediate layer 13) after baking is desired to have a thermal expansion coefficient of $(65 \text{ to } 80)\times10^{-7}/°$ C., which is equivalent to that of the alumina substrate (support substrate 12).

Figure 3E:
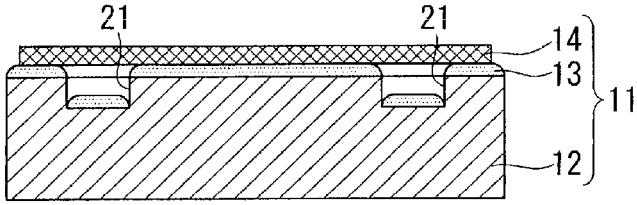
FIG. 3E is a vertical sectional view illustrating a bonding step of the method of manufacturing a thermal head according to the embodiment of the present invention.
Figure 3F:
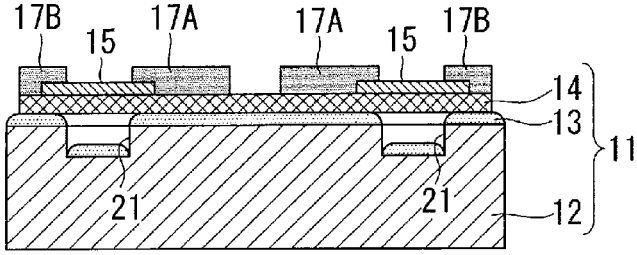
FIG. 3F is a vertical sectional view illustrating a resistor forming step and an electrode forming step of the method of manufacturing a thermal head according to the embodiment of the present invention.
Figure 3G:
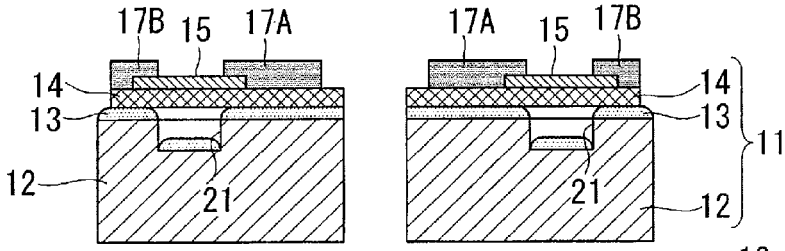
FIG. 3G is a vertical sectional view illustrating a cutting step of the method of manufacturing a thermal head according to the embodiment of the present invention.
Figure 3H:
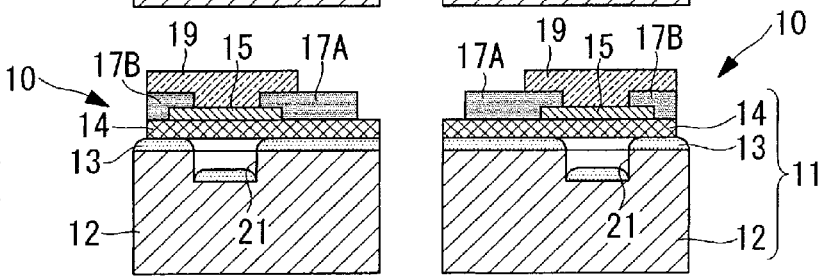
FIG. 3H is a vertical sectional view illustrating a protective film forming step of the method of manufacturing a thermal head according to the embodiment of the present invention.

In the bonding step S3, as illustrated in FIG. 3E, the upper substrate 14 made of a second glass material is arranged on the intermediate layer 13 formed on the one surface of the support substrate 12 in a laminated state in such a manner that an opening portion of the concave portion 21 is closed. Then, the upper substrate 14 is heated at a temperature of an annealing point or higher and a softening point or lower so as to be bonded to the one surface of the support substrate 12 (Step S3).

As the second glass material, for example, a glass material having a softening point lower than that of the first glass material is used. The upper substrate 14 made of this second glass material is desired to have a thickness dimension of, for example, 10 to 100 nm.

The upper substrate 14 is desired to have a thermal expansion coefficient of (65 to 80)×$10^{-7}$/° C., which is equivalent to that of the alumina substrate (support substrate 12). For example, as the upper substrate 14, there is used a glass plate of borosilicate glass and the like, which has a thermal expansion coefficient adjusted to that of alumina. Borosilicate glass has an annealing point of about 550° C. or higher and a softening point of about 800° C. or lower, and hence, when borosilicate glass is used as the upper substrate 14, the bonding temperature is desired to be in a range of from 550° C. or higher to 800° C. or lower.

In the bonding step S3, a laminated substrate 11 is formed in which the support substrate 12 and the upper substrate 14 are bonded to each other through the intermediation of the intermediate layer 13. In the laminated substrate 11, the upper substrate 14 covers a surface of the intermediate layer 13 and closes the opening portions of the concave portions 21 of the support substrate 12, thereby forming a plurality of cavity portions 23 between the support substrate 12 and the upper substrate 14.

In the resistor forming step S4, by using a thin film forming method such as sputtering, chemical vapor deposition (CVD), and vapor deposition, a thin film of a heat generating resistor material is formed on the upper substrate 14. Then, the thin film of the heat generating resistor material is shaped by lift-off, etching, and the like, to thereby form the heat generating resistor 15 having a desired shape (Step S4).

The heat generating resistor 15 is formed on the surface of the upper substrate 14 bonded to the support substrate 12 at a position opposed to the concave portion 21 of the support substrate 12 in the plate thickness direction. As the heat generating resistor material, for example, a Ta-based or silicide-based material is used. The heat generating resistor 15 is formed into a substantially rectangular shape, and has a longitudinal dimension slightly larger than the width dimension of the concave portion 21 of the support substrate 12.

In the electrode forming step S5, similarly to the resistor forming step S4, a film of a wiring material is formed on the upper substrate 14 by sputtering, vapor deposition, and the like and is shaped by lift-off or etching, or the wiring material is baked after screen printing, thereby forming the electrode portions 17A and 17B which have desired shapes (Step S5).

The electrode portions 17A and 17B include a plurality of individual electrodes 17A each of which is connected to one end of a heat generating resistor 15 in the longitudinal direction, and a common electrode 17B which is common to all the heat generating resistors 15 and is connected to the other end of each of the heat generating resistors 15 in the longitudinal direction. As the wiring material, for example, Al, Al—Si, Au, Ag, Cu, or Pt is used.

These electrode portions 17A and 17B can supply electric power from an external power supply (not shown) to the heat generating resistors 15 to cause the heat generating resistors 15 to generate heat. A region in the heat generating resistor 15 between the individual electrode 17A and the common electrode 17B, that is, a region in the heat generating resistor 15 substantially immediately above the concave portion 21 of the support substrate 12 is an effective heat generation region.

In the cutting step S6, the large laminated substrate 11 is cut into the regions of the individual thermal heads 10 (Step S6).

In the protective film forming step S7, a film of a protective film material is formed on the upper substrate 14 by sputtering, ion plating, CVD, and the like, to thereby form the protective film 19 (Step S7). As the protective film material, for example, $SiO_2$, $Ta_2O_5$, SiAlON, $Si_3N_4$, or diamond-like carbon is used.

From the above-mentioned steps, the thermal head 10 is completed which has the heat generating resistor 15, the electrode portions 17A and 17B, and the protective film 19 formed on the one surface of the laminated substrate 11 having the support substrate 12 and the upper substrate 14 bonded to each other in a laminated state through the intermediation of the intermediate layer 13, and which has the cavity portion 23 formed between the support substrate 12 and the upper substrate 14 in a region opposed to the heat generating resistor 15.

In this case, the concave portion 21 is formed in the support substrate 12 in advance in the support substrate processing step S1, and therefore, even if the glass paste 13*a* flows into the concave portion 21 in the intermediate layer forming step S2, the cavity portion 23 having a desired shape is secured. Therefore, there is no need to form a high heat-resistant film as a partition or to precisely control the viscosity of the glass paste 13*a*, and cost and manufacturing time are reduced.

Prior to the bonding step S3, the glass paste 13*a* is baked to form the intermediate layer 13 in the intermediate layer forming step S2. Therefore, even if the upper substrate 14 is heated at a temperature of a softening point thereof or lower in the bonding step S3, a cavity due to binder removal is not generated in the intermediate layer 13, and the intermediate layer 13 is maintained in the same state as that of glass. As a result, the strength of the intermediate layer 13 is prevented from being reduced.

In the bonding step S3, the upper substrate 14 is heated at a temperature of an annealing point thereof or higher and a softening point thereof so as to be bonded to the support substrate 12, and therefore deformation of the upper substrate 14 is prevented. Further, the first glass material for the intermediate layer 13 has a softening point higher than that of the second glass material for the upper substrate 14, and hence the cavity portion 23 having a desired shape is formed without losing the shape of the intermediate layer 13 in the bonding step S3.

As the first glass material for the glass paste 13*a* forming the intermediate layer 13 and the second glass material for the upper substrate 14, there are used materials having thermal expansion coefficients almost the same as that of the support substrate 12 made of an alumina material. Therefore, deformation due to heat generated in printing is not caused, and the bonding force is not reduced, and hence the highly-reliable thermal head 10 is manufactured.

Description is given of the function of the thermal head 10 manufactured in this way.

When a voltage is selectively applied to the individual electrode 17A, a current flows through the heat generating resistor 15 to which the selected individual electrode 17A and the opposed common electrode 17B are connected, and the heat generating resistor 15 generates heat. The heat generated in the heat generating resistor 15 is transferred to the protective film 19 side and is used for printing and the like. On the other hand, part of the heat is transferred from the upper substrate 14 to the support substrate 12 side through the intermediate layer 13.

The upper substrate 14 functions as a heat storage layer which stores the heat generated in the heat generating resistor 15. On the other hand, the cavity portion 23 arranged between the upper substrate 14 and the support substrate 12 in such a manner that the cavity portion 23 becomes opposed to the heat generating resistor 15 functions as a hollow heat-insulating layer for suppressing transfer of heat from the heat generating resistor 15 to the support substrate 12 side. The depth of the concave portion 21 is the same as the thickness of the cavity portion 23, and hence the thickness of the hollow heat-insulating layer is easily controlled.

Therefore, the cavity portion 23 suppresses dissipation of part of the heat generated in the heat generating resistor 15 from the upper substrate 14 to the support substrate 12 side through the intermediate layer 13. This increases an amount of heat to be transferred from the heat generating resistor 15 to the protective film 19 side so as to be used in printing and the like, and improves utilization efficiency. Further, when printing is performed continuously, excess heat generated in the heat generating resistor 15 transfers from the upper substrate 14 to the support substrate 12 through the intermediate layer 13, and therefore high print quality with less tailing is obtained, and the printing speed is increased.

As described above, in the method of manufacturing a thermal head according to the embodiment of the present invention, as the upper substrate 14, the second glass material having a softening point lower than that of the intermediate layer 13 made of the first glass material is used, and the upper substrate 14 is heated at the temperature of an annealing point or higher and a softening point thereof so as to be bonded to the support substrate 12 through the intermediation of the intermediate layer 13. In this way, the cavity portion 23 having a desired shape is formed without losing the shape of the intermediate layer 13 in the bonding step S3, and deformation of the upper substrate 14 is prevented. As a result, the thermal head 10 which may improve the print quality and increase the printing speed is manufactured easily and at low cost.

In the embodiment of the present invention, in the support substrate processing step S1, the concave portion 21 is formed in the alumina substrate after baking. Alternatively, however, the concave portion 21 may be formed in advance in a green sheet which is to be baked to form an alumina substrate, and then the green sheet may be baked to form the support substrate 12.

Figure 4A:
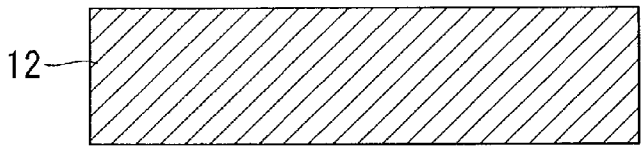
FIGS. 4A and 4B are vertical sectional views illustrating a support substrate processing step of a method of manufacturing a thermal head according to a modified example of the embodiment of the present invention.
Figure 4B:
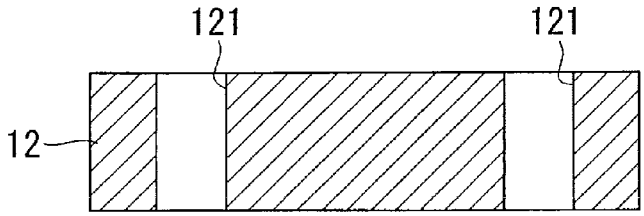
Figure 4C:
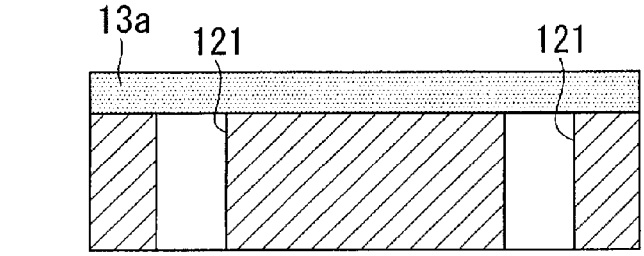
FIGS. 4C and 4D are vertical sectional views illustrating an intermediate layer forming step of the method of manufacturing a thermal head according to the modified example of the embodiment of the present invention.
Figure 4D:
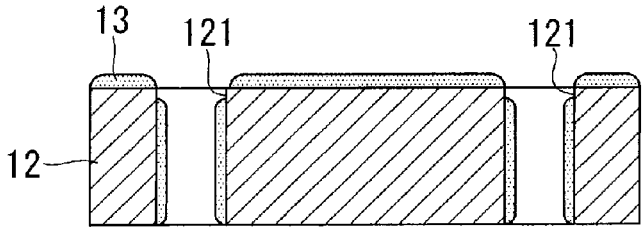
Figure 4E:
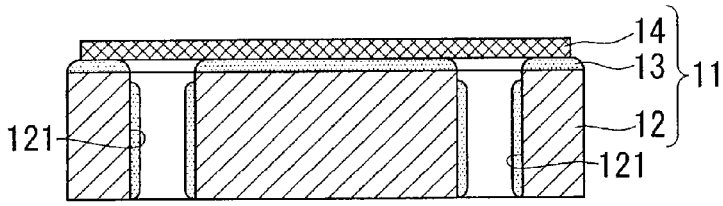
FIG. 4E is a vertical sectional view illustrating a bonding step of the method of manufacturing a thermal head according to the modified example of the embodiment of the present invention.
Figure 4F:
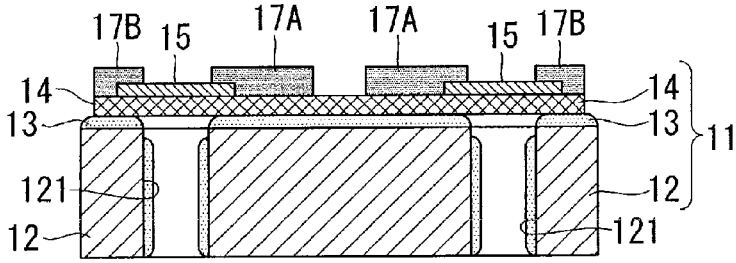
FIG. 4F is a vertical sectional view illustrating a resistor forming step and an electrode forming step of the method of manufacturing a thermal head according to the modified example of the embodiment of the present invention.
Figure 4G:
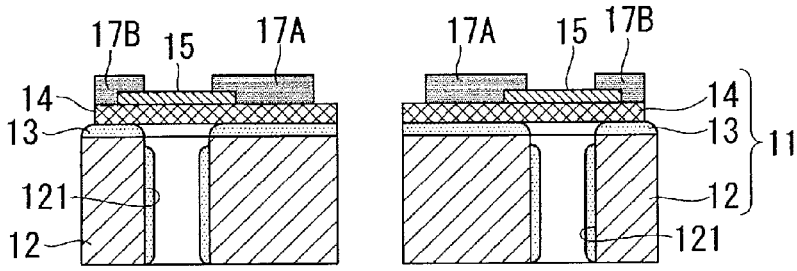
FIG. 4G is a vertical sectional view illustrating a cutting step of the method of manufacturing a thermal head according to the modified example of the embodiment of the present invention.
Figure 4H:
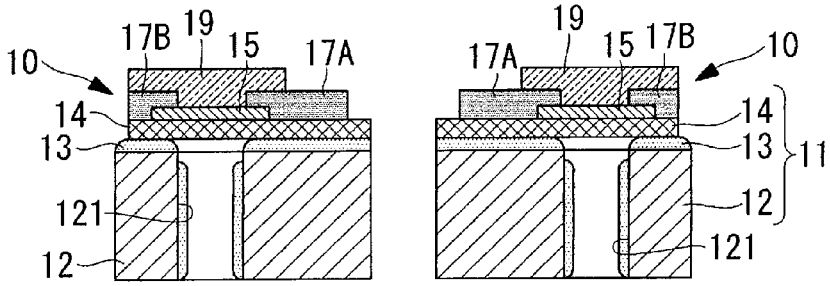
FIG. 4H is a vertical sectional view illustrating a protective film forming step of the method of manufacturing a thermal head according to the modified example of the embodiment of the present invention.

In the embodiment of the present invention, in the support substrate processing step S1, the concave portion 21 is formed in the support substrate 12. However, instead of the concave portion 21, as illustrated in FIGS. 4A and 4B, there may be formed a through hole 121 which is open on the one surface of the substantially rectangular support substrate 12 and which passes therethrough in the plate thickness direction. As in the embodiment of the present invention, in the case of manufacturing the plurality of thermal heads 10 by using the large support substrate 12 and the large upper substrate 14, the through holes 121 may be formed in respective regions of the thermal heads 10 in the support substrate 12.

In this case, as illustrated in FIGS. 4C to 4H, a method for forming the intermediate layer 13 in the intermediate layer forming step S2, a method for bonding the support substrate 12 and the upper substrate 14 to each other in the bonding step S3, a method for forming the heat generating resistor 15 in the resistor forming step S4, a method for forming the electrode portions 17A and 17B in the electrode forming step S5, a cutting method in the cutting step S6, and a method for forming the protective film 19 in the protective film forming step S7 are the same as in the case of forming the concave portion 21 in the support substrate 12, and therefore description thereof is omitted.

When the through hole 121 is formed instead of the concave portion 21, the upper substrate 14 closes an opening portion on one end of the through hole 121, and the thermal head 10 on the support substrate 12 side is fixed to a heat sink (not shown), to thereby form the cavity portion 23. Therefore, also in this modified example of the present invention, the same effect as in the case of forming the cavity portion 23 by the concave portion 21 is obtained.

In the embodiment of the present invention, in the bonding step S3, a glass plate having a thickness dimension of 10 to 100 μm is used as the upper substrate 14, and the glass plate is bonded to the one surface of the support substrate 12 so as to form the upper substrate 14. However, for example, there may be provided a thinning step of thinning a glass plate to a desired thickness, the glass plate being bonded to the one surface of the support substrate 12 through the intermediation of the intermediate layer 13 in the bonding step S3.

In this way, in the bonding step S3, instead of bonding a glass plate too thin to be easily handled to the intermediate layer, a glass plate thick enough to be easily handled is bonded to the support substrate 12, and then, the glass plate is thinned in the thinning step so as to form the upper substrate 14 having a desired thickness. Therefore, the upper substrate 14 is handled easily and safely.

In the embodiment of the present invention, in the bonding step S3, as the upper substrate 14, the glass plate of borosilicate glass and the like, which has a thermal expansion coefficient adjusted to that of alumina, is used. However, a glass paste containing borosilicate glass as a major component or a green sheet (LTCC) formed by blending ceramic powder with glass powder may be arranged on the surface of the intermediate layer 13 in a laminated state in such a manner that the opening portion of the concave portion 21 or the through hole 121 is closed, and the glass paste or the green sheet may be baked while being bonded to the intermediate layer 13.

In this step, when the glass paste is used as the upper substrate 14, the support substrate 12 may be placed using a fixture or the like in such a manner that the support substrate 12 on the glass paste side faces downward in a vertical direction, and the glass paste and the support substrate 12 may be bonded to each other. In this way, the glass paste is reliably prevented from flowing into the concave portion 21 or the through hole 121, and the upper substrate 14 is formed stably.

In the embodiment of the present invention, the plurality of thermal heads 10 are formed using the large support substrate 12 and the large upper substrate 14, and are cut into the individual thermal heads 10 in the cutting step S6. Alternatively, however, the thermal heads 10 may be manufactured individually using the support substrates 12 and the upper substrates 14 which are cut in advance for the respective thermal heads 10.

In the embodiment of the present invention, in the support substrate processing step S1, the concave portion 21 is formed into such a size that all the heat generating resistors 15 are opposed thereto in the plate thickness direction. Alternatively, however, the plurality of concave portions 21 or the plurality of through holes 121 may be formed which have such sizes that the respective heat generating resistors 15 are opposed thereto in the plate thickness direction. In this case, the concave portions 21 or the through holes 121 may be formed individually at respective positions where the heat generating resistors 15 are to be formed in the resistor forming step S4.

In the embodiment of the present invention, in the bonding step S3, a large glass plate is used for the upper substrate 14 in accordance with the large support substrate 12, and is bonded to the large support substrate 12. Alternatively, however, the large support substrate 12 and the upper substrates 14 processed in advance into appropriate sizes for the respective thermal heads 10 may be used so as to be bonded to each other in the respective regions of the thermal heads 10.

What is claimed is:

1. A method of manufacturing a thermal head, including:

a support substrate processing step of forming a concave portion, which is open on one surface of a support substrate made of an alumina material;

an intermediate layer forming step of forming an intermediate layer made of a glass paste by printing the glass paste made of a first glass material on the one surface of the support substrate and baking the glass paste;

a bonding step of bonding an upper substrate to the one surface of the support substrate by arranging the upper substrate on the intermediate layer formed on the one surface of the support substrate in a laminated state and heating the upper substrate at a temperature of an annealing point thereof or higher and a softening point thereof or lower, the upper substrate being made of a second glass material having a softening point lower than a softening point of the first glass material; and a resistor forming step of forming a heat generating resistor on a surface of the upper substrate bonded to the support substrate at a position opposed to the concave portion.

2. A method of manufacturing a thermal head according to claim 1, further including:

a thinning step of thinning the upper substrate bonded to the intermediate layer in the bonding step.

3. A thermal head manufactured by the method of manufacturing a thermal head according to claim 2.

4. A printer comprising the thermal head according to claim 3.

5. A thermal head manufactured by the method of manufacturing a thermal head according to claim 1.

6. A printer comprising the thermal head according to claim 5.

7. A method of manufacturing a thermal head, including:

a support substrate processing step of forming a through hole, which is open on one surface of a support substrate made of an alumina material;

an intermediate layer forming step of forming an intermediate layer made of a glass paste by printing the glass paste made of a first glass material on the one surface of the support substrate and baking the glass paste;

a bonding step of bonding an upper substrate to the one surface of the support substrate by arranging the upper substrate on the intermediate layer formed on the one surface of the support substrate in a laminated state and heating the upper substrate at a temperature of an annealing point thereof or higher and a softening point thereof or lower, the upper substrate being made of a second glass material having a softening point lower than a softening point of the first glass material; and a resistor forming step of forming a heat generating resistor on a surface of the upper substrate bonded to the support substrate at a position opposed to the through hole.

8. A method of manufacturing a thermal head according to claim 7, further including:

a thinning step of thinning the upper substrate bonded to the intermediate layer in the bonding step.

9. A thermal head manufactured by the method of manufacturing a thermal head according to claim 8.

10. A printer comprising the thermal head according to claim 9.

11. A thermal head manufactured by the method of manufacturing a thermal head according to claim 7.

12. A printer comprising the thermal head according to claim 11.

* * * * *